United States Patent [19]

Zosky et al.

[11] Patent Number: 4,778,209

[45] Date of Patent: Oct. 18, 1988

[54] WASTE MATERIAL COLLECTION TUB

[75] Inventors: Edmund A. Zosky, 1426 N. Main St., East Peoria, Ill. 61611; Thomas A. Zosky, Peoria; Donald E. Stambaugh, Astoria, both of Ill.

[73] Assignee: Edmund A. Zosky, East Peoria, Ill.

[21] Appl. No.: 20,692

[22] Filed: Mar. 2, 1987

[51] Int. Cl.[4] ..... B65D 88/56

[52] U.S. Cl. ..... 294/68.27; 220/1 T; 294/68.1

[58] Field of Search ..... 294/68.1–68.22, 294/68.26–68.3; 220/1 T, 1.5, 71, 72, 85 R, 91; 414/406–409, 424, 425

[56] References Cited

U.S. PATENT DOCUMENTS

| | | | |
|---|---|---|---|
| 303,051 | 8/1884 | Rooks | 294/68.27 |
| 1,152,342 | 8/1915 | Perkins | 294/68.27 |
| 1,408,383 | 2/1922 | Mosel | 294/68.26 |
| 1,929,607 | 10/1933 | Pollock et al. | 294/68.27 |
| 2,087,054 | 7/1937 | Wallace | 294/68.27 |
| 2,384,307 | 9/1945 | Husson et al. | 294/68.27 X |
| 2,535,179 | 12/1950 | Wallsworth | 294/68.3 |
| 2,823,061 | 2/1958 | Pottorf | 294/68.27 |
| 2,878,051 | 3/1959 | Jones | 294/68.27 X |
| 4,450,828 | 5/1984 | Onken et al. | 414/406 X |

FOREIGN PATENT DOCUMENTS

| | | | |
|---|---|---|---|
| 1414532 | 9/1965 | France | 294/68.27 |

*Primary Examiner*—Johnny D. Cherry
*Attorney, Agent, or Firm*—Ralph E. Walters

[57] ABSTRACT

The present invention relates to a waste material collection tub which is provided with a pair of selectively removable tub dumping pins which are precisely located in relation to the tub lifting pins for use with appropriate material transport vehicles to ensure a longer life for such tubs and to maintain them in good working condition throughout such period. The prior art tubs only provide rigid non-removable dumping pins which are exposed to the severe environment, or subject to damage by being struck by other vehicles in the high traffic areas adjacent to commercial sites and cannot be nested together with other similar tubs during transport from site to site. The present invention overcomes these problems by providing a tub with exterior reinforcing straps enabling the interior surfaces of the side walls of the tub to be completely uncluttered and also to provide a convenient mounting structure so that the dumping pins can be quickly and conveniently mounted on the tubs only during the dumping operation and thereafter conveniently removed and stored for safe keeping until the next dumping operation.

6 Claims, 1 Drawing Sheet

FIG. 1
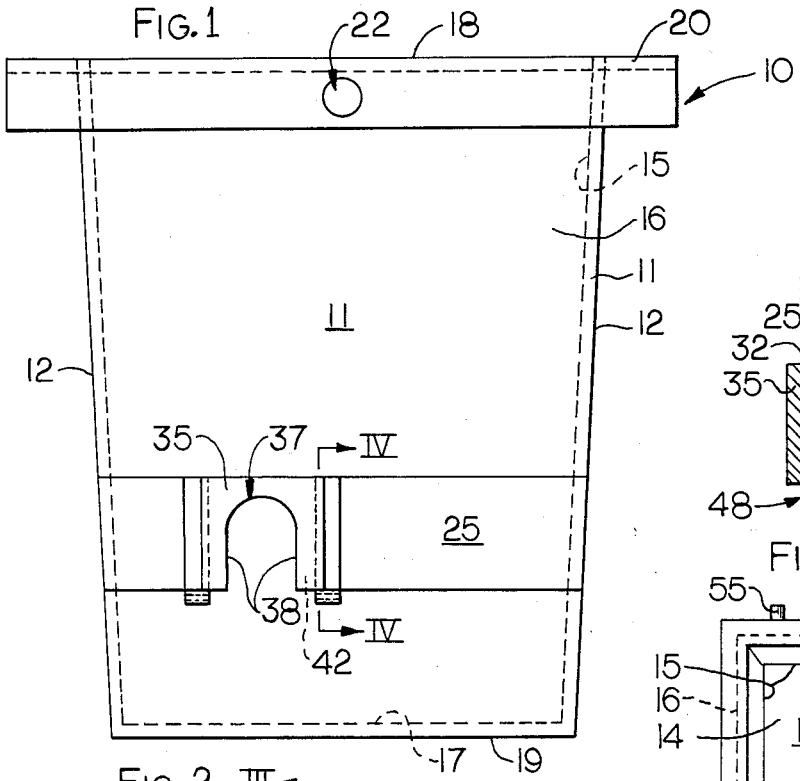
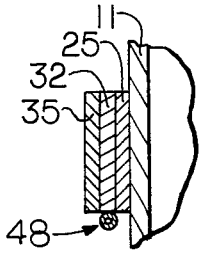
FIG. 4
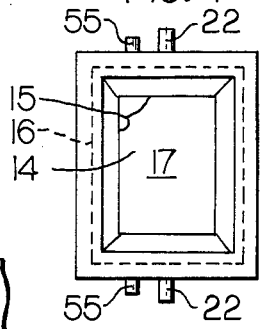
FIG. 6
FIG. 2
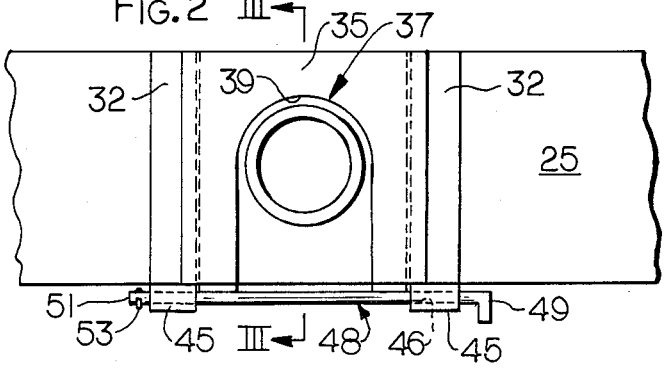
FIG. 3
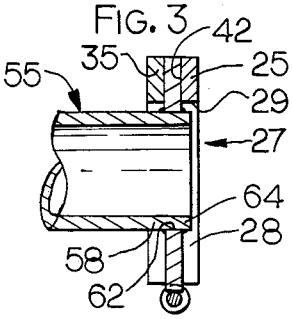
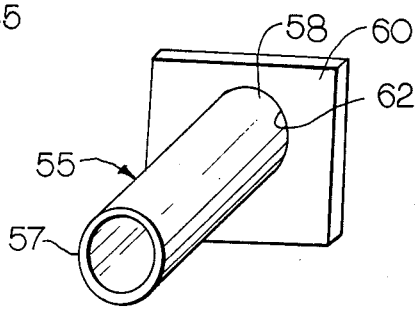
FIG. 5

WASTE MATERIAL COLLECTION TUB

DESCRIPTION

1. Technical Field

The present invention generally relates to a waste material collection tub and method of use and more particularly to such tubs which are usually located behind a restaurant or other commercial site for temporarily storing waste material therein until periodically picked up and their contents dumped into a waste material transport vehicle for removal of the waste material from the site.

2. Background Art

Conventional waste material collection tubs and their use are typically disclosed and described in U.S. Pat. No. 4,450,828 issued on May 29, 1984, to Donald R. Onken, et al. This patent shows a waste material collection tub primarily for collecting and temporarily storing used deep-frying grease with the tub being of generally rectangular configuration and having a pair of upwardly disposed outwardly extended tub lifting lugs and a pair of lower laterally offset tub dumping lugs. The lugs are rigidly non-removably mounted on the tubs either by welding or by providing some type of bolting flanges on the tubs. Such rigid mountings have been found to be highly disadvantageous due to the inability to nest several tubs together when it is desirable to transport them from one collection site to another. Even with the bolted on types of lugs, the bolts and nuts are subject to the harsh outside environment which causes them to rust and corrode and which usually become frozen in place making it virtually impossible to remove. When this occurs, removal can only be accomplished by a manually manipulated hammer and chisel or an acetylene torch which not only destroys the lugs but also frequently results in serious damage to the sides of the tubs. In addition, the permanently mounted tub dumping lugs are also subject to damage from backing vehicles, which if not completely removed from the tubs, are frequently bent to such an extent that they no longer can be aligned with the dumping lug receiving mechanism on the transport vehicle.

A further disadvantage with the abovedescribed conventional tubs is that in order to dependably hold the relatively high loads encountered with various types of waste material, the side walls thereof are usually corrugated or are provided with large channular sections for added rigidity. Such channular wall configurations are not only difficult and expensive to manufacture, but afford undesirable grooves or pockets within the tubs which collect compacted waste material that cannot be easily dislodged from the tub during the dumping operation. This usually requires manual cleaning of the tubs to remove such impacted material.

It is therefore recognized that an improved waste material collection tub is desirable which can provide easily selectively mountable and removable tub dumping lugs or pins and relatively smooth interior side walls to better assure complete emptying of the tubs into the transport vehicle. Accordingly, the present invention is directed to overcoming the problems as set forth above.

DISCLOSURE OF THE INVENTION

In accordance with one aspect of the present invention there is provided a waste material collection tub which utilizes a plurality of tapered side walls having substantially flat planar inner and outer surfaces with a pair of tub lifting pins individually outwardly extended in opposed relation from said outer surfaces of the side walls which are centrally located adjacent to the top edge of the tub with the tub further including a pair of opposed outwardly extended tub dumping pins individually selectively removably mounted on said pair of opposite side walls in downwardly spaced laterally offset relation to said lift pins.

BRIEF DESCRIPTION OF THE DRAWING

FIG. 1 is a side elevational view of a material collecting tub embodying the principles of the present invention showing a dumping pin mounting structure on the side wall thereof with the dumping pin removed.

FIG. 2 is a somewhat enlarged elevational view of the dumping pin mounting structure of FIG. 1 showing the dumping pin in an installed position.

FIG. 3 is a vertical cross section through the pin and pin mounting structure taken along the line III—III of FIG. 2.

FIG. 4 is a further enlarged vertical cross section through the pin mounting structure taken along the line IV—IV of FIG. 1.

FIG. 5 is a three-dimensional view of the tub dumping pin of the preceding Figures removed from the tub.

FIG. 6 is a top plan view of the waste material collection tub of the preceding Figures.

BEST MODE FOR CARRYING OUT THE INVENTION

Referring more particularly to the drawings and as best shown in FIGS. 1 and 6, a material collection tub embodying the principles of the present invention is generally indicated by the reference numeral 10. The tub has a plurality of side walls 11 constructed of a relatively heavy sheet metal material which are joined together at corners 12 as by welding or the like in a substantially rectangular configuration and in circumscribing relation to a waste material collection compartment 14. The side walls present substantially flat inner and outer surfaces 15 and 16, respectively. The tub further includes a bottom wall 17, again rigidly connected to the side walls 11 by welding or the like. Each side wall 11 tapers downwardly from an upper edge 18 to an opposite lower edge 19. An enlarged overhanging upper reinforced flange 20 is disposed in circumscribing relation around the plurality of side walls 11 which mounts a pair of outwardly extended lifting pins 22. The pins are individually disposed in an opposed relation from opposite ones of a pair of side walls in a substantially central location adjacent to the upper edge 18 thereof. The lift pins are also rigidly secured to the side walls and to the upper flange by welding which provides a sufficiently rigid structure to permit lifting of the entire collection tub when full of waste material by lifting chains or the like from a material collection and transport vehicle, not shown.

The pair of opposed side walls 11 which mount the lifting pins 22 further include an elongated reinforcing strap 25 which enables the inner surface of the side walls to be completely free of any bracing. The strap is welded to the outer surface of the side walls in substantially flat overlying relation and in upwardly closely spaced substantially parallel relation to the bottom wall 17 of the tub. The strap has a downwardly opening notch 27 providing oppositely spaced substantially parallel side edges 28 terminating in an upper arcuately closed upper end 29. A pair of spacer bars 32 are individually welded in overlying relation to the reinforcing strap 25 in laterally outwardly spaced parallel relation with associated side edges 28 on either side of the notch 27.

A substantially flat rectangular-shaped guide plate 35 is mounted in overlying bridging relation between the spacer bars 32 and is secured thereto by welding or the like. The guide plate has a pin guiding slot 37 which is the same size and configuration as the notch 27 in the reinforcing strap 25. The slot provides a pair of spaced vertically extended side edges 38 terminating in an upper arcuately closed end 39 precisely aligned with the upper closed end 29 of the strap. With the guide plate disposed on the spacer bars 32, a downwardly opening pin mounting pocket 42 is thus formed between the guide plate 35 and the reinforcing strap 25.

As best shown in FIGS. 2 and 3, a pair of elongated cylindrical sleeves 45 are individually welded to the lower edge of each of the spacer bars 32 in aligned coaxial relation with each other. Each sleeve has a cylindrical bore 46 therein which is adapted to receive an elongated locking rod 48 which has a L-shaped handle end 49 and an opposite distal end 51. The locking rod 48 is slideably extendable through the bores 46 in the sleeves 45 in dependable locking relation to the pocket 42. A cotter pin 53 is extendable through a suitable hole in the distal end 51 to retain the rod in the described locking position.

A tub dumping pin 55 is adapted to be releasably mounted on the side wall 11 of the tub by the above described mounting structure in outwardly extending relation therefrom at a position downwardly spaced and laterally offset from the tub lifting pins 22. As best shown in FIGS. 3 and 5, each tub dumping pin 55 includes an elongated cylindrical body providing an outer end 57 and an opposite inner end 58. A substantially square flat pin mounting plate 60 is provided having a circular bore 62 therethrough which is adapted to receive the inner end 58 of the dumping pin 55. The pin and mounting plate are securely welded together with the inner end of the pin extending through the plate a short distance to provide a guiding projection 64 for the pin during installation on the tub. The mounting plate 60 is of a size to be upwardly slideably received within the pocket 42 of the pin mounting structure between the side edges 38 of the spacer bars 32.

Industrial Applicability

In use, the material collection tub 10 of the present invention is disposed behind a restaurant or other commercial site without the tub dumping pins 55. The dumping pins 55 and the locking rods 48 are carried on the transport vehicle which during a collection visit is parked closely adjacent to the material collection tub 10. The dumping pins are then installed on the tub by sliding the pin mounting plate 60 upwardly within the pocket 42 during which time the pin is accurately guided by the guide slot 37 in the guide plate 35. During such movement the projection 64 of the pin through the mounting plate is also guided upwardly through the notch 27 in the reinforcing strap 25 on the tub. The dumping pin 55 and mounting plate 60 are temporarily held in the installed position of FIG. 2 and the locking rod 48 extended in sliding relation through the bores 46 and the sleeves 45 and the cotter pin 53 installed with the rod positioned in supporting relation beneath the mounting plate 60.

The lift pins 22 are then engaged by the appropriate lifting chains, not shown, or other lifting mechanism on the transport vehicle and the tub lifted into the vehicle for positioning the dumping pins with the dumping mechanism thereon to cause tipping of the tub and the emptying of its contents into the material collecting receptacle on the vehicle, not shown. It is significant that most of the weight of the tubs is transferred from the dumping pins through the reinforcing straps and into the side walls of the tub. Such weight transfer occurs as the inner end 58 and projection 64, respectively, engage the closed upper ends 29 and 39 of the guide slots 27 and 37 on either side of the pin mounting plate 60. It is also significant that during such dumping operation, the tapered substantially flat uncluttered inner side wall surfaces 15 of the tubs ensure complete cleaning and emptying of waste material therefrom. This is made possible by the reinforcing straps 25 being located on the outer surfaces 16 of the side walls 11 to provide added rigidity to the walls. The straps also provide the dual function of providing a mounting base for the dumping pin mounting structure which permits the dumping pins 55 to be conveniently removed between uses and stored on the transport vehicle for use at the next collection tub site. After dumping, the tub 10 is returned to its original collecting position on the ground and the dumping pins 55 easily and conveniently removed by reversing the above-described installation procedure.

In view of the foregoing it is readily apparent that the material collection tub 10 of the present invention provides a vastly superior system by which the tub dumping pins 55 can be installed and readily removed after use so as not to be exposed to the harsh environment between dumping operations and which provide relatively clean tapered side walls for the tub that can be easily nested with other tubs for transport when desirable to move the tubs to different collection sites.

We claim:

1. A waste material collection tub, comprising;

side walls having top and bottom edges and providing substantially flat planar inner and outer surfaces;

a pair of tub lifting pins individually outwardly extended in opposed relation from said outer surfaces of a pair of opposite side walls and substantially centrally located adjacent to said top edges of the tub;

a pair of opposed outwardly extended tub dumping pins individually removably mounted on said pair of opposite side walls in downwardly spaced laterally offset relation to said lift pins;

and means for releasably mounting said tub dumping pins in operating position on the tub including an elongated substantially horizontally disposed tub reinforcing strap rigidly secured to each of said opposite side walls of the tub and having a downwardly opening upwardly closed pin guiding notch therein.

2. The waste material collection tub of claim 1 wherein said notch has oppositely spaced vertically extended side edges;

and a pair of elongated spacer bars rigidly secured to said reinforcing strap and individually extending in laterally spaced substantially parallel relation to said opposite side edges of the notch.

3. The waste material collection tub of claim 2 including a substantially flat plate rigidly mounted on said spacer bars in covering bridging relation to the bars;

and said plate having an elongated downwardly opening upwardly closed pin receiving slot disposed in outwardly spaced aligned relation to said notch in said strap and forming a pin mounting pocket between it and said reinforcing strap and between said spacer bars.

4. The waste material collection tub of claim 3 including a substantially flat mounting plate rigidly secured closely adjacent to one end of each of said tub dumping pins and being slidable into said pockets on the tub with the pins providing a guiding projection oppositely extended from the plates for slidable receipt within their associated notches in the tub reinforcing strap.

5. The waste material collection tub of claim 4 wherein said spacer bars have upper and lower ends;

a pair of cylindrical sleeves individually rigidly secured to said lower ends of the bars in aligned coaxial relation to each other.

6. The waste material collection tub of claim 5 including an elongated locking rod slidably removably extendable through said sleeves in retaining relation to said pin mounting plate within said pocket.

* * * * *